US012385209B2

(12) United States Patent
Cheek et al.

(10) Patent No.: US 12,385,209 B2
(45) Date of Patent: Aug. 12, 2025

(54) SEDIMENT CONTROL DEVICE

(71) Applicants: Hollis C. Cheek, Kosciusko, MS (US); H. Randolph Cheek, Kosciusko, MS (US)

(72) Inventors: Hollis C. Cheek, Kosciusko, MS (US); H. Randolph Cheek, Kosciusko, MS (US)

( * ) Notice: Subject to any disclaimer, the term of this patent is extended or adjusted under 35 U.S.C. 154(b) by 188 days.

(21) Appl. No.: 17/857,722

(22) Filed: Jul. 5, 2022

(65) Prior Publication Data

US 2024/0011236 A1 Jan. 11, 2024

(51) Int. Cl.
*E01F 7/00* (2006.01)
*E02D 17/20* (2006.01)
*E04H 17/22* (2006.01)

(52) U.S. Cl.
CPC ..... *E02D 17/20* (2013.01); *E04H 17/22* (2013.01)

(58) Field of Classification Search
CPC ..... E01F 7/00; E01F 7/02; E01F 7/025; E01F 7/04; E01F 7/045; E02D 17/20; E02D 3/005; E02D 2300/0087; E04H 17/22; E04H 12/22
USPC ..... 256/12.5, 13
See application file for complete search history.

(56) References Cited

U.S. PATENT DOCUMENTS 546,161 A * 9/1895 Kimball ..... E04H 12/2276 52/297
680,342 A * 8/1901 Martin ..... E04H 12/2269 256/48
2,118,474 A * 5/1938 Whitton ..... E04H 15/003 135/93
3,166,871 A * 1/1965 Simison ..... E04H 12/22 52/297
3,381,763 A * 5/1968 Matson ..... E04H 17/18 173/132
3,471,129 A * 10/1969 Mpakarakes ..... E04H 17/18 256/25
3,537,688 A * 11/1970 Stein ..... E04H 15/005 47/29.6
3,822,850 A * 7/1974 Elias ..... E04G 21/3233 248/200.1
3,920,220 A * 11/1975 Elias ..... E04G 21/3233 248/200.1
3,940,113 A * 2/1976 Hirsch ..... E04H 17/266 256/34
4,279,535 A * 7/1981 Gagliardi ..... E02B 3/12 405/32

(Continued)

OTHER PUBLICATIONS

International Search Report and Written Opinion issued for PCT/US2023/068469, mailed Sep. 28, 2023 (12 pages).

*Primary Examiner* — Edwin J Toledo-Duran
(74) *Attorney, Agent, or Firm* — Armstrong Teasdale LLP

(57) ABSTRACT

A sediment control device is disclosed. The device includes an elongate fabric and a plurality of sleeves attached to the fabric. The plurality of sleeves extend generally perpendicular to a longitudinal axis of the fabric and are configured to receive a stake for securing the sediment control device to soil. Each sleeve is spaced a distance from an adjacent sleeve. In use, the fabric is laid out along a soil path, a bottom portion of the fabric is trenched into soil, and the stake is inserted into each sleeve such that the sediment control device is secured to soil. The bottom portion can then be backfilled.

17 Claims, 9 Drawing Sheets

(56) References Cited

U.S. PATENT DOCUMENTS 4,316,595 A * 2/1982 Wheeler ..... B28B 23/06 249/94
4,606,070 A * 8/1986 Schachter ..... A45C 9/00 383/4
4,685,484 A * 8/1987 Moneta ..... E04H 15/003 135/900
4,939,877 A * 7/1990 Claffey ..... E02D 5/80 52/156
5,029,819 A * 7/1991 Kane ..... E01F 13/028 160/24
5,460,353 A * 10/1995 Rittenhouse ..... E01F 9/692 256/64
5,494,371 A * 2/1996 Oberth ..... E01F 15/146 404/6
5,595,230 A * 1/1997 Guerra ..... B08B 17/04 160/237
6,092,792 A * 7/2000 Camara ..... E04H 15/003 256/25
6,098,353 A * 8/2000 Stanfield ..... E01F 9/685 52/848
6,692,188 B1 * 2/2004 Walker ..... E02B 3/106 405/91
8,215,055 B2 * 7/2012 Miller ..... A01G 9/28 47/31
8,276,683 B1 * 10/2012 Roy ..... B25D 1/16 173/132
9,107,387 B1 * 8/2015 Pavlik ..... A01K 1/034
9,777,447 B1 * 10/2017 Hipfl ..... E02D 3/005
11,384,492 B2 * 7/2022 Schaaf ..... E01F 7/025
2002/0172564 A1 * 11/2002 Brown ..... E01F 7/025 405/116
2006/0133897 A1 * 6/2006 Allard ..... E02B 11/005 405/36
2008/0073633 A1 * 3/2008 Gelfand ..... E01F 13/024 256/23
2008/0157044 A1 * 7/2008 Barfield ..... E02B 3/04 256/12.5
2009/0315007 A1 * 12/2009 Cox ..... E01F 7/045 256/13.1
2010/0313470 A1 * 12/2010 Miller ..... A01G 13/23 47/20.1
2011/0017968 A1 * 1/2011 Christoffer ..... E04G 21/3223 256/65.14
2012/0251236 A1 * 10/2012 Hild ..... E01F 9/635 404/6
2013/0221301 A1 * 8/2013 Cowie ..... E04H 17/00 256/24
2014/0154018 A1 * 6/2014 Singleton ..... E02B 5/085 210/170.03
2015/0021532 A1 * 1/2015 Smith ..... E04H 17/05 256/65.01
2015/0159394 A1 * 6/2015 Oliveira ..... E04H 12/2246 135/15.1
2015/0197958 A1 * 7/2015 Wilson ..... E04H 17/14 256/10
2015/0345099 A1 * 12/2015 Griffiths ..... E02D 5/80 52/165
2016/0237635 A1 * 8/2016 Schaaf ..... E02D 5/80
2016/0362865 A1 * 12/2016 Segroves ..... E02D 17/202
2017/0138006 A1 * 5/2017 Wiegel ..... E01F 13/024
2019/0352867 A1 * 11/2019 Schaaf ..... E01F 7/025

* cited by examiner

SEDIMENT CONTROL DEVICE

FIELD OF THE DISCLOSURE

The field of the disclosure relates generally to sediment control devices and, more particularly, to sediment control devices having a sleeve attached to a fabric for receiving a stake.

BACKGROUND

Sediment control devices such as silt fences are utilized to minimize soil erosion caused by the elements. Common silt fences are made of an elongate fabric trenched into the soil and secured by a plurality of stakes attached to the fabric and driven into the soil. The elongate fabric can be soil-impermeable or water-impermeable so that soil or water from a construction site does not cross into nearby ecosystems. Soil-impermeable fabrics allow for water runoff to pass through the silt fence while the soil is retained, and water-impermeable fabrics, which are used less frequently, prevent both soil and water from passing through the silt fence.

In use, the fabric is stretched between wooden or metal stakes along a desired soil control path, and a bottom edge of the fabric is trenched into the soil and backfilled. The fabric can be pre-attached to the stakes, or the stakes can be attached to the fabric after trenching and driving of the stakes into the soil. The fabric is attached to the stakes by suitable fasteners, e.g., staples, wire ties or zip-tie fasteners. Often, at least three attachment points are required to properly secure the fabric to the stakes. During typical installation, a first team of laborers are required to measure stake spacing and to drive the stakes into the soil to a specified depth, while a second team of laborers secure the fabric to each stake along the path. The fabric often has to be stretched and held stationary while a laborer secures the fabric to the stake.

Silt fences can fail due to improper spacing of the stakes or failing to adequately secure the stakes to the fabric. Thus, some applications require additional reinforcement of the fabric to prevent heavier soil particles such as rock or clay from rupturing the fabric. Commonly, the fabric is reinforced by a backing of wire mesh or chain link fence. Where reinforcement is required, laborers must also secure the wire mesh or chain link to the fabric and to the stakes.

Therefore, there is a need in the art for a sediment control device that reduces the labor requirement for installation while also streamlining the spacing of stakes and the attachment of stakes onto the fabric of the silt fence.

BRIEF DESCRIPTION

In one aspect, a sediment control device is disclosed. The sediment control device includes an elongate fabric and a plurality of sleeves. The elongate fabric has a front, a back, a top edge, a bottom edge, a first lateral edge, and a second lateral edge. The plurality of sleeves are attached to the back of the fabric, and each sleeve of the plurality of sleeves extends generally perpendicular to a longitudinal axis of the elongated fabric. Each sleeve of the plurality of sleeves is configured to receive a stake for securing the sediment control device to soil.

In another aspect, a method of installing a sediment control device into soil is disclosed. The method includes positioning a bottom edge of an elongate fabric on the soil, the elongate fabric having a front, a back, a top edge, a first lateral edge, and a second lateral edge; inserting a stake into a sleeve of a plurality of sleeves attached to a back surface of the fabric, each sleeve of the plurality of sleeves extending generally perpendicular to a longitudinal axis of the elongated fabric and being configured to receive the stake for securing the sediment control device to soil; and, further inserting the stake into the soil to secure the fabric to the soil In another aspect, a sediment control kit is disclosed. The sediment control kit includes an elongate fabric and a plurality of stakes. The elongate fabric has a front, a back, a top edge, a bottom edge, a first lateral edge, and a second lateral edge, and a plurality of sleeves attached to the back of the elongate fabric. Each sleeve of the plurality of sleeves extending generally perpendicular to a longitudinal axis of the elongate fabric and is configured to receive the stake for securing the sediment control device to soil.

BRIEF DESCRIPTION OF THE DRAWINGS

The reference symbols used in the drawings, and their meanings, are listed in summary form in the list of reference symbols. In principle, identical parts are provided with the same reference symbols in the figures.

DETAILED DESCRIPTION

In the following specification and the claims, reference will be made to a number of terms, which shall be defined to have the following meanings.

As used herein, the singular forms "a," "an," and "the" include plural references unless the context clearly dictates otherwise. The terms "comprising," "including," and "having" are intended to be inclusive and mean that there may be additional elements other than the listed elements. The terms "optional" or "optionally" means that the subsequently described event or circumstance may or may not occur, and that the description includes instances where the event occurs and instances where it does not.

Embodiments of the present disclosure are directed to a sediment control device including an elongate fabric and a plurality of sleeves attached to the fabric. The plurality of sleeves extend generally perpendicular to a longitudinal axis of the fabric and are configured to receive a stake for securing the sediment control device to soil. Each sleeve is spaced a predefined distance from an adjacent sleeve. In use, the fabric is extended along a soil path, a bottom portion of the fabric is trenched into soil, and the stake is inserted into each sleeve such that the sediment control device is secured to soil, and the fabric is stretched between inserted stakes. The bottom portion can then be backfilled.

As shown in FIGS. 1 through 4, a sediment control device, indicated generally at 100, of the present disclosure includes an elongate fabric 120 and a plurality of sleeves 150 attached to the elongate fabric. Each of the plurality of sleeves 150 are configured to receive a stake 190 for securing the elongate fabric 120 to soil.

Figure 1:
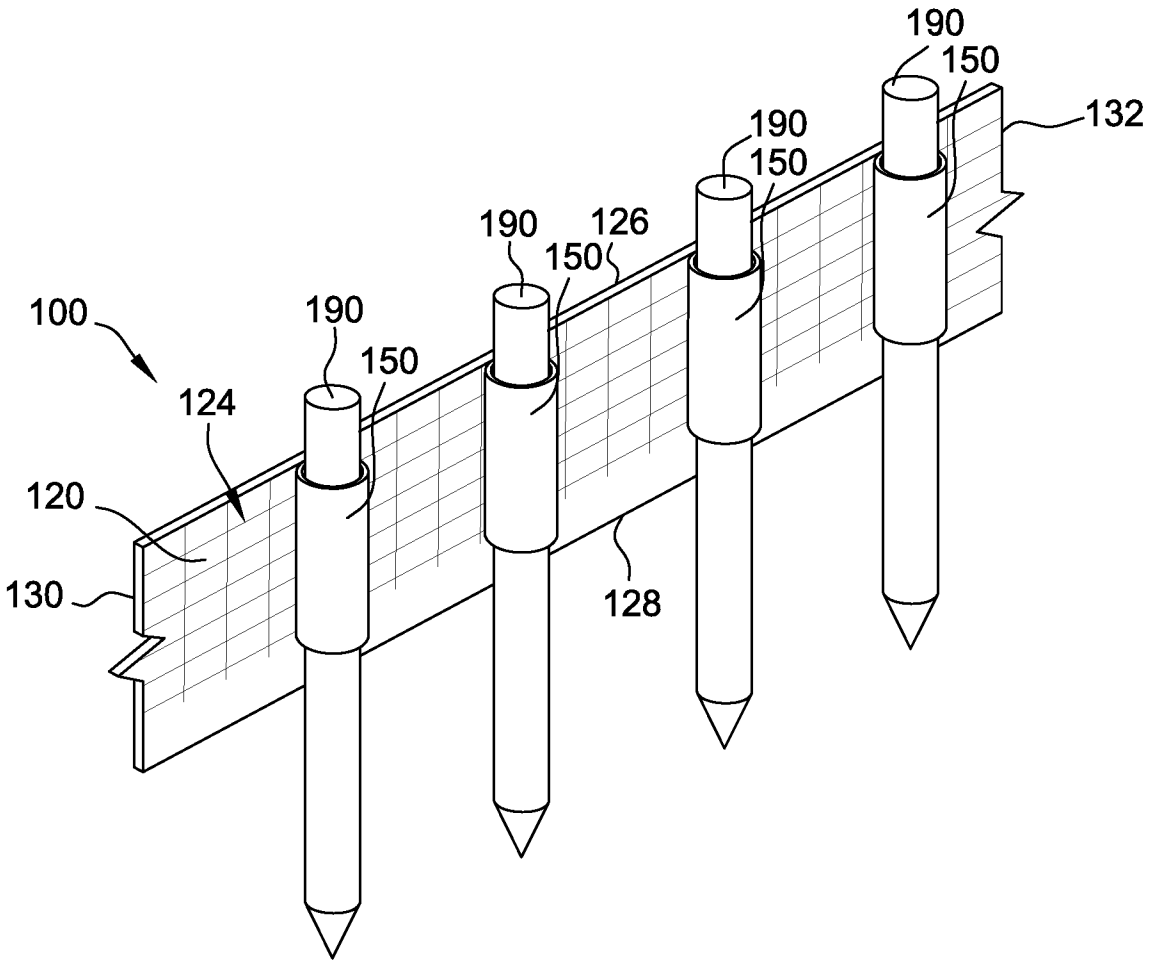
FIG. 1 is a perspective view of a sediment control device in accordance with one or more embodiments of the present disclosure.
Figure 2:
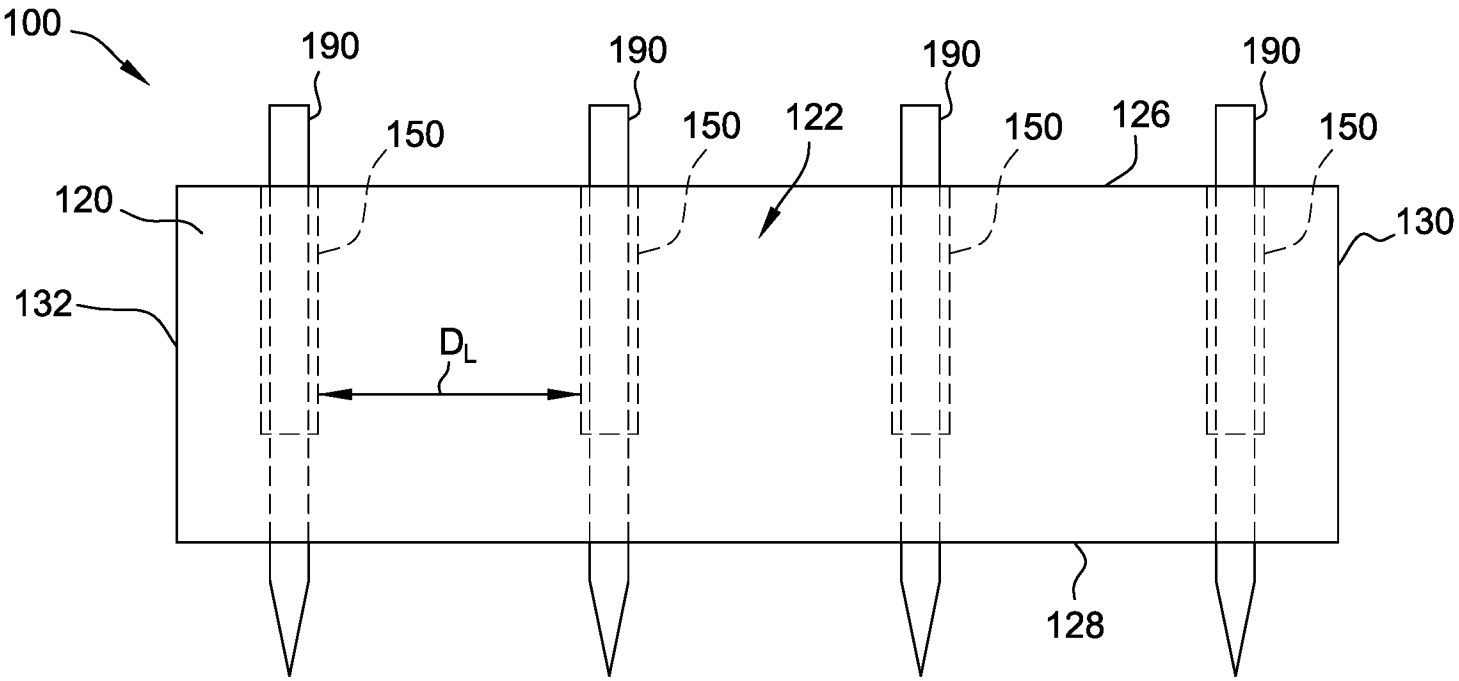
FIG. 2 is a front view of the sediment control device of FIG. 1.
Figure 3:
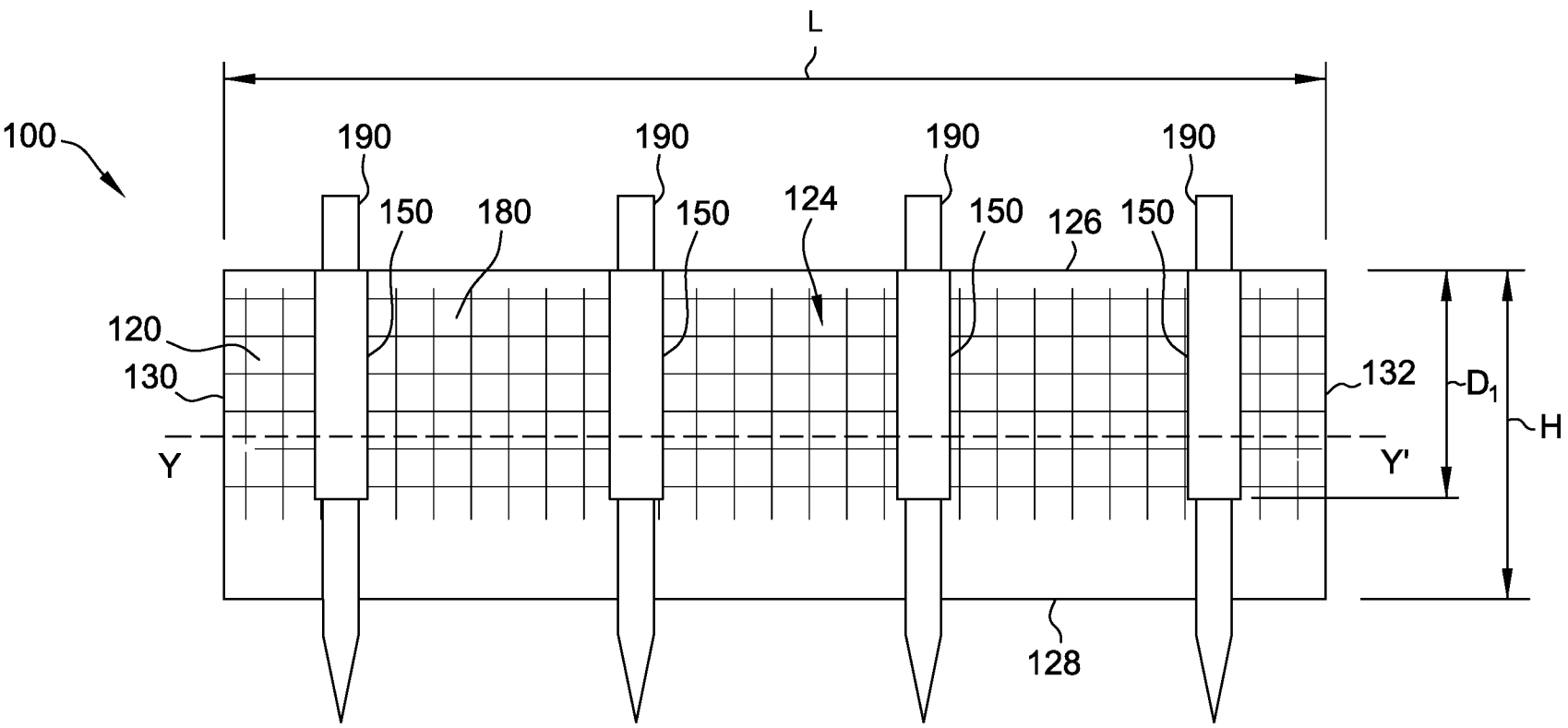
FIG. 3 is a back view of the sediment control device of FIG. 1.

The elongate fabric 120 of the exemplary embodiment shown in FIGS. 1-4 is an elongate, flexible, rectangular sheet having a front 122 (FIG. 2) and a back 124 (FIG. 1), a top edge 126 and a bottom edge 128, and a first lateral edge 130 and a second lateral edge 132. With reference to FIG. 3, the top edge 126 and bottom edge 128 define a height H of the elongate fabric 120. The first lateral edge 130 and second lateral edge 132 define a length L of the elongate fabric 120. A longitudinal axis Y extends along the length L of the elongate fabric 120. It is understood that the elongate fabric 120 of the illustrated sediment control device 100 can have any suitable height H and length L without departing from some aspects of this disclosure. For example, the elongate fabric 120 can have a height H in the range of 1 foot to 4 feet, and a length L in the range of 25 feet to 1500 feet. In some embodiments, the height H is in the range of 3 feet to 6 feet. In some embodiments, the length L is in the range of 5 feet to 8 feet, 7 feet to 10 feet or 9 feet to 12 feet. In some embodiments, the elongate fabric 120 is a continuous roll.

In some embodiments, the elongate fabric 120 can be of a soil-impermeable or water-impermeable material so that soil or water from a construction site does not permeate thought the elongate fabric 120 and cross into nearby grounds or ecosystems. In some suitable embodiments, the elongate fabric 120 includes a support structure 180 attached to the back 124 of the elongate fabric. In some other suitable embodiments, the elongate fabric 120 includes a support structure 180 attached to the front 122 of the elongate fabric. The support structure 180 can be attached to either the front 122 and/or back 124 of the elongate fabric to add rigidity to the elongate fabric 120 or to otherwise structurally support the sediment control device 100. In some suitable embodiments, the support structure 180 is a wire mesh or a wire matrix.

Figure 6:
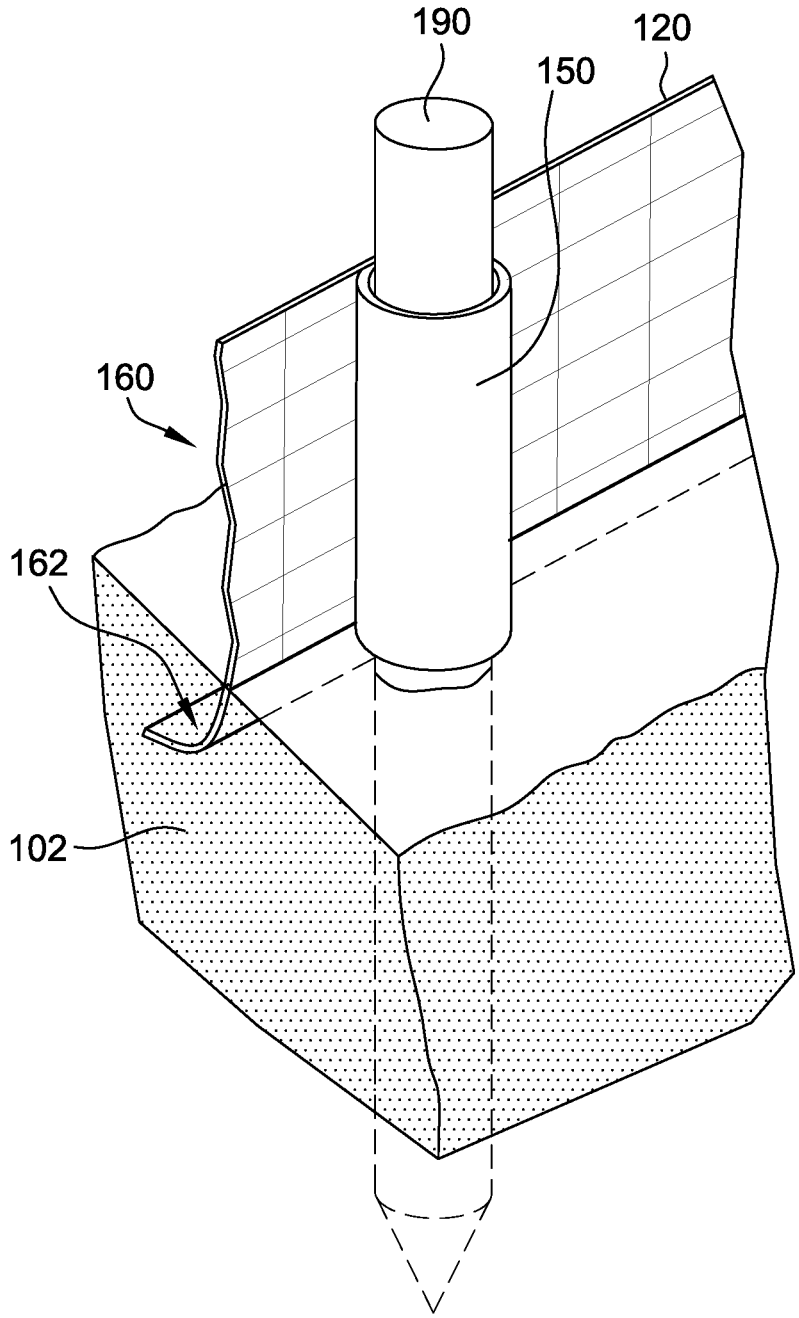
FIG. 6 is an enlarged, partial perspective view of the sediment control device of FIG. 5.

As shown in FIGS. 1 and 3, each sleeve 150 of the plurality of sleeves is attached to the back 124 of the elongate fabric 120. As seen therein, each sleeve extends generally perpendicular to the longitudinal axis Y and is configured to receive a stake 190 for securing the sediment control device 100 to soil 102 (as shown in FIG. 6). In some suitable embodiments, each sleeve 150 of the plurality of sleeves is formed integrally with the elongated fabric 120. In some other suitable embodiments, each sleeve 150 of the plurality of sleeves is welded (or otherwise suitably attached) to the back 124 of the elongate fabric 120. With reference to FIG. 2, each sleeve 150 of the plurality of sleeves is positioned a predefined distance D L from an adjacent sleeve of the plurality of sleeves 150. In some embodiments, the predefined distance D L is in the range of 10 feet to 20 feet. In some embodiments, the predefined distance D L is in the range of 1 foot to 4 feet, 3 feet to 6 feet, 5 feet to 8 feet, 7 feet to 10 feet or 9 feet to 12 feet. In some embodiments, the predefined distance DL is in the range of 12 feet to 16 feet.

Figure 4:
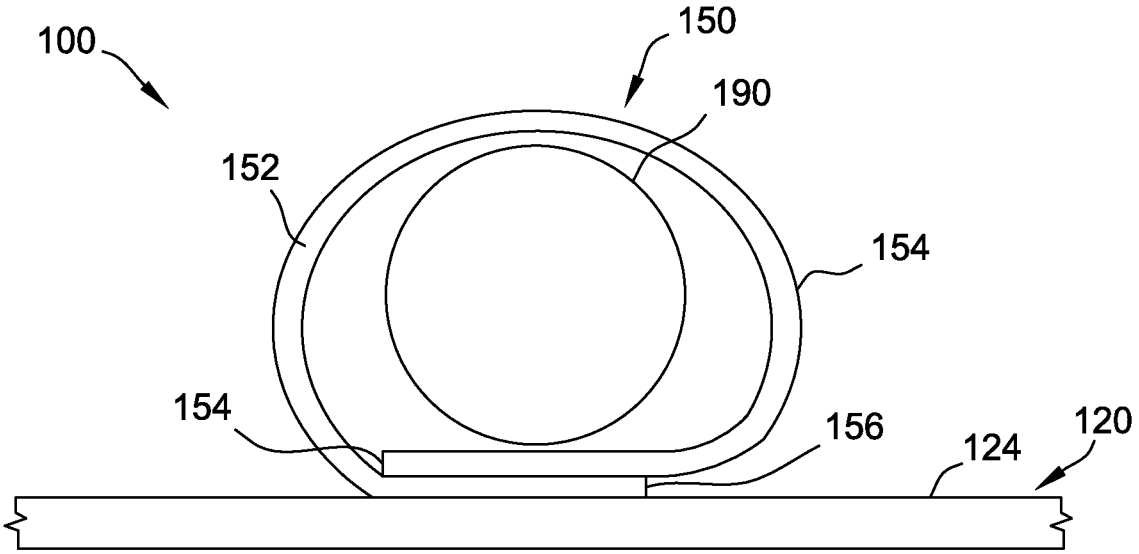
FIG. 4 is an enlarged, partial top view of the sediment control device of FIG. 1.

In some suitable embodiments, each sleeve 150 is formed integral with the elongated fabric 120 by folding the elongate fabric and bonding near the fold. The resulting sleeve 150 and elongate fabric 120 has an omega-shaped ("Ω") cross-section. In some other suitable embodiments, as shown in FIG. 4, each sleeve 150 is formed by looping a discrete sleeve fabric 152, which is formed separately from the elongate fabric 120, and attaching (e.g., by sewing, welding, or bonding) an outer surface 154 of the sleeve 150 to the back 124 of the elongate fabric. In some embodiments, as shown in FIG. 4, lateral ends (156, 158) of the sleeve fabric 152 are folded over each other and bonded together to form each sleeve 150. In some embodiments, lateral ends (156, 158) of the sleeve fabric 152 are connected together to form each sleeve 150. It is contemplated the sleeves 150 can be made from the same material or different material than the elongate fabric 120.

Referring to FIG. 3, in some embodiments, each sleeve 150 of the plurality of sleeves extends a distance $D_1$ from the top edge 126 of the elongate fabric 120. The distance $D_1$ from the top edge 126 of the elongate fabric 120 defines a top portion 160 of the elongate fabric 120. Likewise, a bottom portion 162 of the elongate fabric 120 extends from the bottom edge 128 to the top portion 160 of the elongate fabric 120. As explained in further detail below with reference to FIGS. 5-7 and 9A-9C, the bottom portion 162 of the elongate fabric 120 can be at least partially trenched into soil 102. In some embodiments, the plurality of sleeves 150 extend from the top edge 126 to the bottom edge 128 of the elongate fabric 120, and the bottom edge 128 is positioned against the soil 102. In some embodiments, the distance $D_1$ from the top edge 126 of the elongate fabric 120 is in the range of 2 feet to 3 feet. In some embodiments, the plurality of sleeves 150 extend 20% the length L of the elongate fabric 120. Stated differently, in some embodiments, the distance $D_1$ is 20% the length L of the elongate fabric 120. In some embodiments, the distance $D_1$ is in the range of 20% to 80% the length L of the elongate fabric 120. In some embodiments, a first sleeve 150 of the plurality of sleeves has a distance $D_1$ different from a distance $D_1$ of a second sleeve 150 of the plurality of sleeves. Stated differently, in some embodiments, the plurality of sleeves 150 can have different distances $D_1$.

In some suitable embodiments, the support structure 180 extends from the top edge 126 of the elongate fabric 120 to the bottom portion 162. In some other suitable embodiments, the support structure 180 extends partially into the bottom portion 162 such that only a portion of the support structure 180 is partially trenched into soil. It is contemplated that that no portion of the support structure 180 would be trenched into the soil during use. That is, the support structure 180 would be disposed above the soil during use. As mentioned above, in some suitable embodiments, the support structure 180 can be omitted from the sediment control device 100.

Figure 5:
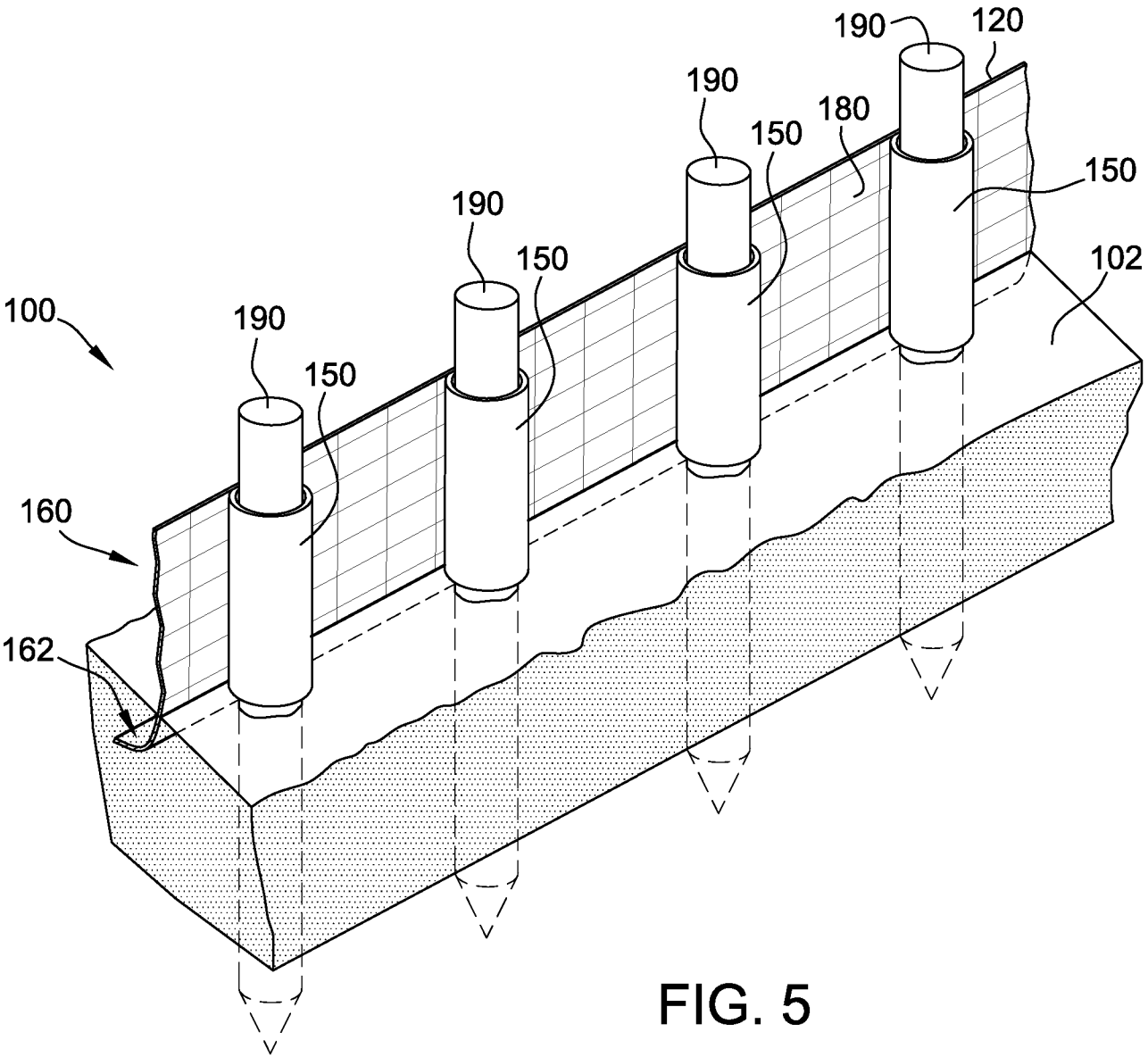
FIG. 5 is a perspective view of the sediment control device of FIG. 1 trenched into soil.
Figure 7:
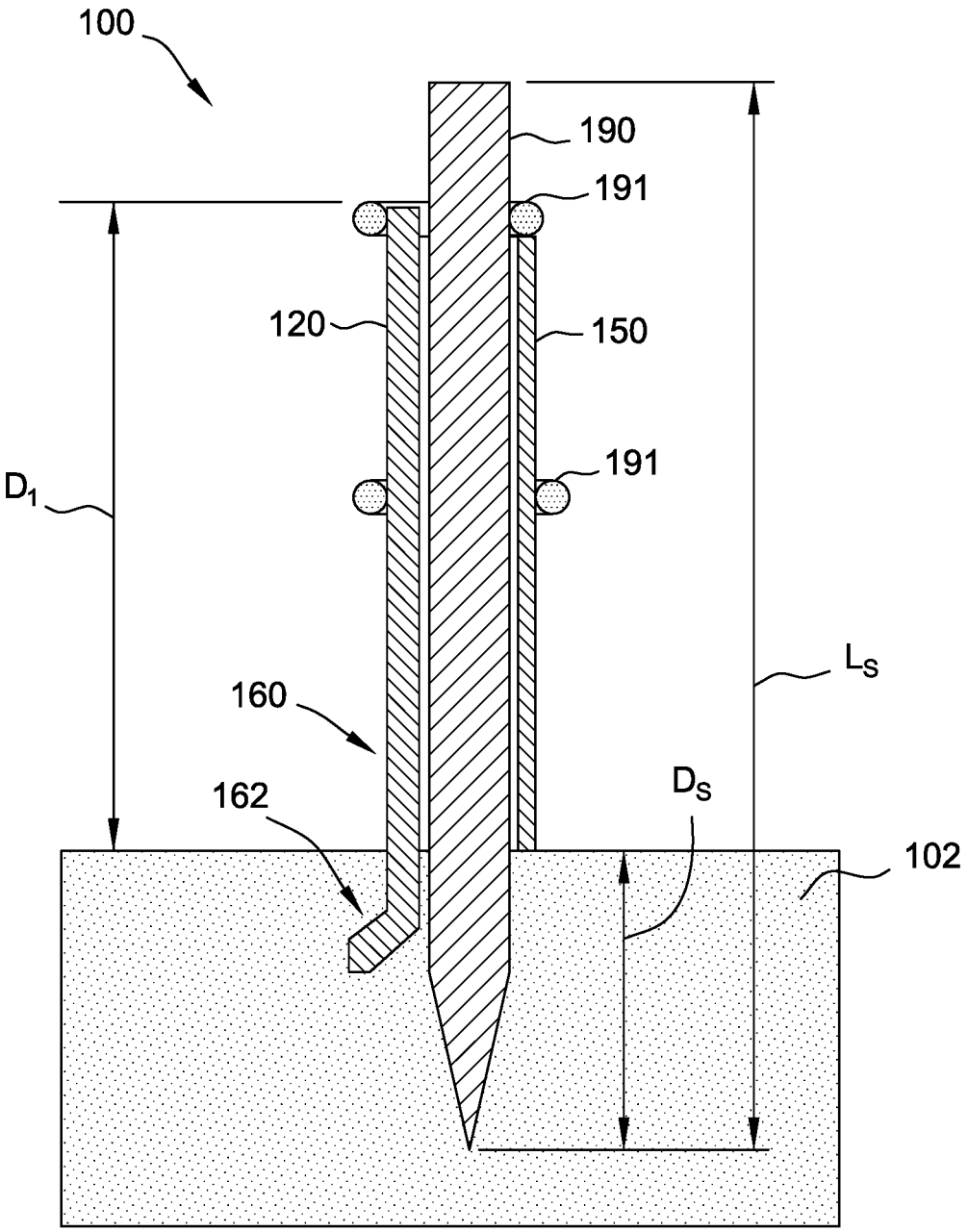
FIG. 7 is a cross-sectional view of the sediment control device of FIG. 5.

Referring to FIGS. 5-7, in use, the bottom portion 162 of the elongate fabric 120 is suitably trenched into soil 102. Due to the flexibility of the elongate fabric 120, the bottom portion 162 of the elongate fabric 120 can be forwardly bent relative to the front 122 of the elongate fabric 120, providing further support to the sediment control device 100. After trenching and backfilling the bottom portion 162 of the elongate fabric 120 into soil 102, the stakes 190 can be inserted into the plurality of sleeves 150 and driven into the soil 102. In the illustrated embodiments, the sediment control device 100 extends along a straight path. In some embodiments, the sediment control device 100 can extend along a curved path due to the flexibility of the elongate fabric 120.

As shown in FIG. 7, each stake 190 has a length Ls greater than the distance $D_1$ of the plurality of sleeves 150 such that the stakes 190 extend beyond the top edge 126 of the elongate fabric 120. Thus, driving the stakes 190 into soil 102 does not damage the elongate fabric 120 or the plurality of sleeves 150. The stakes 190 are driven into the soil 102 by a distance Ds such that the sediment control device 100 is properly secured to the soil 102. The stakes 192 can be secured to the elongate fabric 120 by a securement structure 191 at one or more points along the elongate fabric 120. The securement structure 191 can be, for example, a zip tie, a staple, a wire, or a rebar tie which is passed through the elongate fabric 120.

Figure 8:
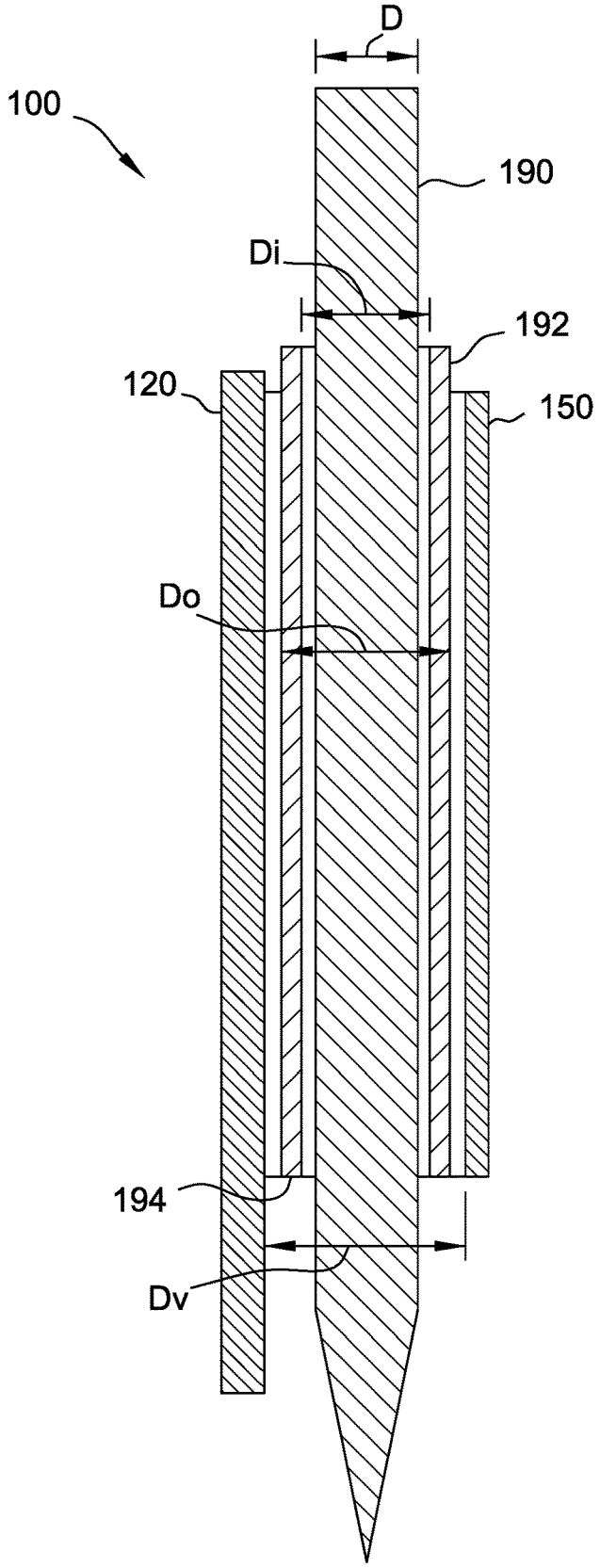
FIG. 8 is a cross-sectional view of the sediment control device in accordance with one or more embodiments of the present disclosure; and, FIGS. 9A through 9C are cross-sectional view of installing the sediment control device of FIG. 1 into soil.

As shown in FIG. 8, in some embodiments, the sediment control device 100 further includes a removable insert 192 which can be inserted into each sleeve of the plurality of sleeves 150 prior to inserting the stake 190. The removable insert 192 is made from a rigid plastic and has a hollow cylindrical body. The removable insert 192 has an inner diameter $D_I$ greater than a diameter D of the stakes 190 and the removable insert 192 has an outer diameter Do lesser than a diameter $D_V$ of the plurality of sleeves 150. Because the sleeve fabric 152 of the plurality of sleeves 150 is flexible, the removable insert 192 causes the plurality of sleeves 150 to form a circular cross-section for aiding in insertion of the stakes 190. Where the stakes 190 are made of wood, the removable insert 192 reduces splintering of the stakes 190 during insertion of the stakes 190 into the plurality of sleeves 150. The removable insert 192 can be removed from each sleeve of the plurality of sleeves 150 after the stake 190 is inserted into the removable insert 192. In the illustrated embodiment, a bottom end 194 of the removable insert 192 has flat cross-section (perpendicular to a length of the removable insert 192). In some embodiments, the bottom end 194 is cut at an oblique angle to aid in insertion of the removable insert 192 into each sleeve of the plurality of sleeves 150. In some embodiments, the bottom end 194 has a V-shape.

Figure 9C:
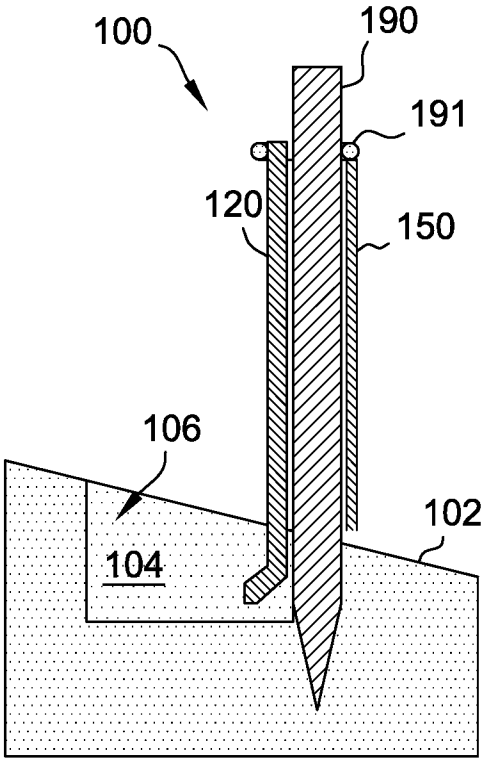
Figure 9B:
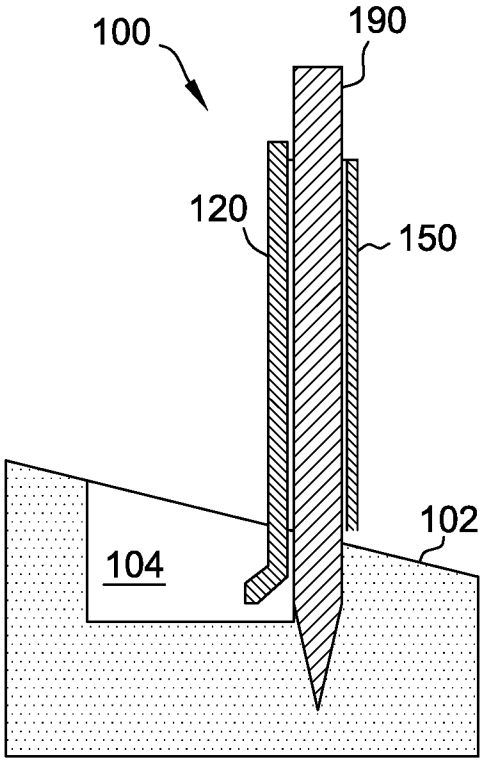
Figure 9A:
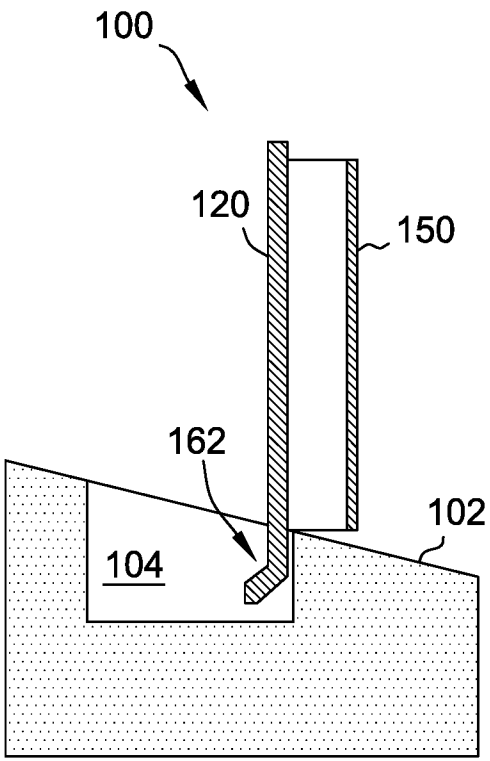

FIGS. 9A through 9C illustrate steps of a method of installing the sediment control device 100 into soil 102. As shown in FIG. 9A, the method includes trenching or digging a trench 104 into the soil 102 along a soil path and placing the bottom edge 128 of the elongate fabric 120 on the soil 102 such that at least the bottom portion 162 of the elongate fabric 120 is placed within the trench 104. As shown in FIG. 9B, the method further includes inserting a stakes 190 into each sleeve of a plurality of sleeves 150 and driving the stakes 190 into the soil 102 to secure the elongate fabric 120 to the soil 102.

As shown in FIG. 9C, the method further includes backfilling the trench 104 with additional soil 106 to fill the trench 104 and bury the bottom portion 162 of the elongate fabric 120 into the soil 102. In some embodiments, the method further includes securing the stake 190 to each sleeve of the plurality of sleeves 150 with the securement structure 191. In some embodiments, the method further includes inserting the removable insert 192 of FIG. 8 into each sleeve of the plurality of sleeves 150 prior to inserting the stake 190 into each sleeve of the plurality of sleeves 150 and, removing the removable insert 192 from each sleeve 190 of the plurality of sleeves 150. In some embodiments, a shovel is used for trenching and backfilling the trench 104, and a hammer or maul is used for driving the stakes 190 into the soil 102. In some embodiments, a rotary hammer is used for driving the stakes 190 into the soil 102.

In use, the elongate fabric 120 of the sediment control device 100 is initially rolled up into a roll and one or two laborers can extend the first lateral edge 130 and the second lateral edge 132 of the elongate fabric 120 along the soil path. The elongate fabric 120 is then held upright at each sleeve of the plurality of sleeves 150 and a stake 190 is driven through each sleeve and into soil 102. Because each sleeve of the plurality of sleeves 150 are positioned the distance DL from adjacent sleeves (of FIG. 2), laborers do not have to pre-measure stake insertion points along the soil path. Furthermore, because the stakes 190 are already attached to the elongate fabric 120 by the plurality of sleeves 150, only one securement structure 191 (of FIG. 7), is needed to secure the stakes 190 to the elongate fabric 120, further reducing labor time during installation of the sediment control device 100.

A sediment control kit can include the elongate fabric 120 and plurality of sleeves 150 rolled into a roll, and the stakes 190 can be bundled up separately. Because the roll does not include the stakes 190, the roll has a significantly lesser diameter than conventional sediment control devices with pre-attached stakes. In some embodiments, the sediment control kit further includes securement structures 191 in a separate container. In some embodiments, the sediment control kit further includes the removable insert 192, or a plurality of removable inserts.

Other variations to the disclosed embodiments can be understood and effected by those skilled in the art in practicing the claimed invention, from the study of the drawings, the disclosure, and the appended claims. In the claims the word "comprising" does not exclude other elements or steps and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the claims.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A sediment control device comprising:

an elongate fabric having a front, a back, a top edge, a bottom edge, a first lateral edge, and a second lateral edge;

a plurality of sleeves attached to the back of the elongate fabric, each sleeve of the plurality of sleeves extending generally perpendicular to a longitudinal axis of the elongate fabric and being configured to receive a stake for securing the sediment control device to soil, each sleeve of the plurality of sleeves being spaced from the bottom edge of the elongate fabric, each sleeve of the plurality of sleeves having an inner diameter and a first continuous height; and an insert sized and shaped for insertion into each sleeve of the plurality of sleeves prior to the sleeve receiving the stake, the insert having an outer diameter that is less than the inner diameter of each sleeve of the plurality of sleeves, the insert having a second continuous height that is greater than the first continuous height of the sleeve, wherein the insert is selectively removed after the stake is received in one of the sleeves of the plurality of sleeves.

2. The sediment control device of claim 1, wherein each sleeve of the plurality of sleeves is formed integrally with the elongated fabric.

3. The sediment control device of claim 1, wherein each sleeve of the plurality of sleeves is welded to the elongate fabric.

4. The sediment control device of claim 1 further comprising a support structure attached to the back of the elongate fabric.

5. The sediment control device of claim 4, wherein the support structure is a wire mesh.

6. The sediment control device of claim 1, wherein each sleeve of the plurality of sleeves extends a distance from the top edge of the elongate fabric, the distance from the top edge of the elongate fabric defining a top portion of the elongate fabric.

7. A method of installing a sediment control device into soil comprising:

positioning a bottom edge of an elongate fabric on the soil, the elongate fabric having a front, a back, a top edge, the bottom edge, a first lateral edge, and a second lateral edge, the elongate fabric further having a plurality of elongate sleeves attached at spaced apart intervals along the back thereof, each sleeve of the plurality of sleeves being spaced from the bottom edge of the elongate fabric, each sleeve of the plurality of sleeves extending generally perpendicular to a longitudinal axis of the elongated fabric and including an inner diameter and a first continuous height;

inserting an insert into one sleeve of the plurality of sleeves, the insert having an outer diameter that is less than the inner diameter of each sleeve of the plurality of sleeves, the insert having a second continuous height that is greater than the first continuous height of the sleeve;

inserting a stake into the removable insert, the removeable insert being sized and shaped to shield the sleeve from the stake;

driving the stake into the soil to secure the elongate fabric to the soil; and removing the insert from the one sleeve of the plurality of sleeves after driving the stake.

8. The method of claim 7, further comprising trenching along a bottom portion of the elongate fabric, the bottom portion extending a distance from the bottom edge.

9. The method of claim 8, further comprising backfilling the bottom portion of the elongate fabric into the soil.

10. The method of claim 7 further comprising securing the stake to each sleeve of the plurality of sleeves.

11. The method of claim 7 wherein the removing of the insert from the one sleeve of the plurality of sleeves further includes removing the insert prior to or subsequent to the driving of the stake into the soil.

12. The method of claim 7 further comprising positioning the first lateral edge and the second lateral edge of the elongate fabric along opposite ends of a soil path prior to inserting stakes into each sleeve of the plurality of sleeves.

13. The method of claim 7, wherein each sleeve of the plurality of sleeves is formed integrally with the elongate fabric.

14. The method of claim 7, wherein the elongate fabric includes a support structure attached to the back of the fabric.

15. A sediment control kit comprising:

an elongate fabric having:

a front, a back, a top edge, a bottom edge, a first lateral edge, and a second lateral edge; and a plurality of sleeves attached to the back of the elongate fabric, each sleeve of the plurality of sleeves extending generally perpendicular to a longitudinal axis of the elongate fabric and being configured to receive a stake for securing the sediment control device to soil, each sleeve of the plurality of sleeves being spaced from the bottom edge of the elongate fabric, each sleeve of the plurality of sleeves having an inner diameter and a first continuous height;

an insert sized and shaped for insertion into each sleeve of the plurality of sleeves prior to the sleeve receiving the stake, the insert having an outer diameter that is less than the inner diameter of each sleeve of the plurality of sleeves, the removeable insert having a second continuous height that is greater than the first height of the sleeve; and a plurality of stakes, each of the plurality of stakes configured to be inserted into the insert and one of the sleeves of the plurality of sleeves, wherein the insert is selectively removed after the stake is received in one of the sleeves of the plurality of sleeves.

16. The sediment control kit of claim 15, wherein the elongate fabric is a roll.

17. The sediment control kit of claim 16, wherein the insert and the plurality of stakes are separate from the roll of elongate fabric.

* * * * *